US007398860B2

(12) United States Patent
Amano

(10) Patent No.: US 7,398,860 B2
(45) Date of Patent: Jul. 15, 2008

(54) REMOTE SUPERVISORY CONTROL SYSTEM FOR ELEVATING MACHINE

(75) Inventor: Masaaki Amano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 483 days.

(21) Appl. No.: 10/553,606

(22) PCT Filed: May 21, 2004

(86) PCT No.: PCT/JP2004/007296

§ 371 (c)(1),
(2), (4) Date: Oct. 18, 2005

(87) PCT Pub. No.: WO2005/113400

PCT Pub. Date: Dec. 1, 2005

(65) Prior Publication Data

US 2006/0260880 A1 Nov. 23, 2006

(51) Int. Cl.
*B66B 1/28* (2006.01)

(52) U.S. Cl. ..... 187/247; 187/391

(58) Field of Classification Search ..... 187/247, 187/248, 380–388, 391–396
See application file for complete search history.

(56) References Cited

U.S. PATENT DOCUMENTS

| | | | | |
|---|---|---|---|---|
| 4,567,560 | A * | 1/1986 | Polis et al. | 700/79 |
| 4,568,909 | A * | 2/1986 | Whynacht | 187/393 |
| 5,892,190 | A * | 4/1999 | Morita et al. | 187/382 |
| 6,560,221 | B1 | 5/2003 | Hara et al. | |
| 2003/0057029 | A1 * | 3/2003 | Fujino et al. | 187/391 |
| 2007/0012523 | A1 * | 1/2007 | Chiba | 187/393 |

FOREIGN PATENT DOCUMENTS

| | | |
|---|---|---|
| JP | 06-156907 | 6/1994 |
| JP | 8-282931 | 10/1996 |
| JP | 10-257098 | 9/1998 |
| JP | 2001-097645 | 4/2001 |
| JP | 2003-089481 | 3/2003 |
| JP | 2004-126754 | 4/2004 |

* cited by examiner

*Primary Examiner*—Jonathan Salata
(74) *Attorney, Agent, or Firm*—Leydig, Voit & Mayer, Ltd.

(57) ABSTRACT

Supervisory control of an elevating machine is performed in a remote supervisory center via a general public line. The general public line has multiple networks including a high-speed digital network for transmitting large quantities of information from the elevating machine to the center and a low-communication-cost public network for transmitting a control command from the center to the elevating machine. A network selector selects the high-speed digital network in the case of transmission of a large quantity of information and the low-communication-cost public network in the case of transmission of the control command, and causes the selected network to perform transmission. For security, the control encodes and decodes transmitted information individually for each of the networks, and performs collation and authentication of a specific code, which has been added to the control command at the center, at the elevating machine.

4 Claims, 4 Drawing Sheets

FIG. 2

| ELEVATOR→REMOTE SUPERVISORY CENTER | REMOTE SUPERVISORY CENTER→ELEVATOR |
|---|---|
| HIGH-SPEED DIGITAL NETWORK | LOW-COMMUNICATION-COST PUBLIC NETWORK |
| ELEVATOR STATE INFORMATION (ex. CAR POSITION INFORMATION, MALFUNCTION INFORMATION) | CONTROL COMMAND (ex. FLOOR LOCKOUT,CAR STOP REMOTE CONTROL) |
| IMAGE INFORMATION (ex. VIDEO IMAGE WITHIN CAR, IMAGE OF INSTALLED COMPONENT) | |
| AUDIO INFORMATION (ex. SOUND WITHIN CAR, SOUND WITHIN HOISTWAY) | |

REMOTE SUPERVISORY CONTROL SYSTEM FOR ELEVATING MACHINE

TECHNICAL FIELD

The present invention relates to a remote supervisory control system for an elevating machine.

BACKGROUND ART

A remote supervisory control system has conventionally been realized and managed, which connects a plurality of elevating machines to a remote supervisory center installed in a place remote therefrom via a general public line, comprehensively supervises the states of elevating machines such as elevators and escalators, installed in a specific area, and malfunction information on those elevating machines, and controls them if necessary. In response to recent increases in the speed and capacity of general public lines, high-speed digital networks for realizing the Internet and the like have been widely set up in addition to conventional analog lines, using existing phone lines. This has made it possible to perform high-speed, real-time transmission of image information and audio information. On the other hand, since open networks such as the Internet can be accessed by the general public, the necessity to consider security functions for information has been growing further.

Under such circumstances, some proposals have been made as to conventional remote supervisory control systems for elevating machines. For example, JP 6-156907 A proposes the idea of connecting a control apparatus, a camera within a car, and an interphone to a remote supervisory device via a high-speed digital communication line and simultaneously transmitting control signals, audio signals, and image signals. This enables high-speed transmission of a large quantity of information such as images and sounds. Further, according to JP2003-89481A, the phone number of a service information center is stored in a terminal device on an elevator side. In the event of a call, it is determined whether or not a calling number is a predetermined one. A response is made only when those numbers coincide with each other. This is supposed to prevent strangers from plotting malicious mischief or obstructive operation.

However, since the conventional remote supervisory control systems for elevating machines are configured as described above, there is a fear that any stranger from the general public may be able to access control information on the elevating machines as well because of, for example, the use of a general high-speed digital line. Further, collation based solely on phone numbers allows any stranger from the general public to access the information once he or she knows the phone number of the service information center. Thus, there is a fear that this stranger will perform an invalid operation on the elevating machine.

It is an object of the present invention to realize a remote supervisory control system for an elevating machine, which enables reliable communication with an enhanced security function through collation with a predetermined specific code by means of an ordinary line as to a control command for an elevating machine, while making it possible to perform high-speed, large-capacity communication by means of a general high-speed digital network as to state information, image information, and audio information on the elevating machine.

DISCLOSURE OF THE INVENTION

In light of the object above, the present invention provides a remote supervisory control system for an elevating machine, which performs supervisory control of at least one of elevating machines in a remote supervisory center via a general public line, the general public line having a plural kinds of networks including a high-speed digital network for transmitting large-capacity information from each of the elevating machines to the remote supervisory center and a low-communication-cost public network for transmitting a control command for performing control for each of the elevating machines from the remote supervisory center, the remote supervisory control system including:

network selection means for, in each of the elevating machines and the remote supervisory center, selecting a required one from a plural kinds of networks according to information to be transmitted and causing the selected network to transmit the information, and for selecting the high-speed digital network when the information to be transmitted is large-capacity information and the low-communication-cost public network when the information to be transmitted is a control command and causing the selected network to transmit the information;

storage means for storing a specific code that is preset and is specific to a relevant one of the elevating machines in each of the elevating machines;

database means for storing the specific code of each of the elevating machines in the remote supervisory center; and security means for, in each of the elevating machines and the remote supervisory center, encoding or decoding transmitted information for each of the plural kinds of networks, for adding the respective specific code to the control command to each of the elevating machines in the remote supervisory center, and for collating for authentication the specific code added to the control command from the remote supervisory center with the specific code stored on the elevating machine side in each of the elevating machines.

BRIEF DESCRIPTION OF THE DRAWINGS

FIG. 2 is a diagram showing kinds of information transmitted in the remote supervisory control system shown in FIG. 1.

BEST MODES FOR CARRYING OUT THE INVENTION

Embodiments of the present invention will be described hereinafter with reference to the drawings.

Embodiment 1

Figure 1:
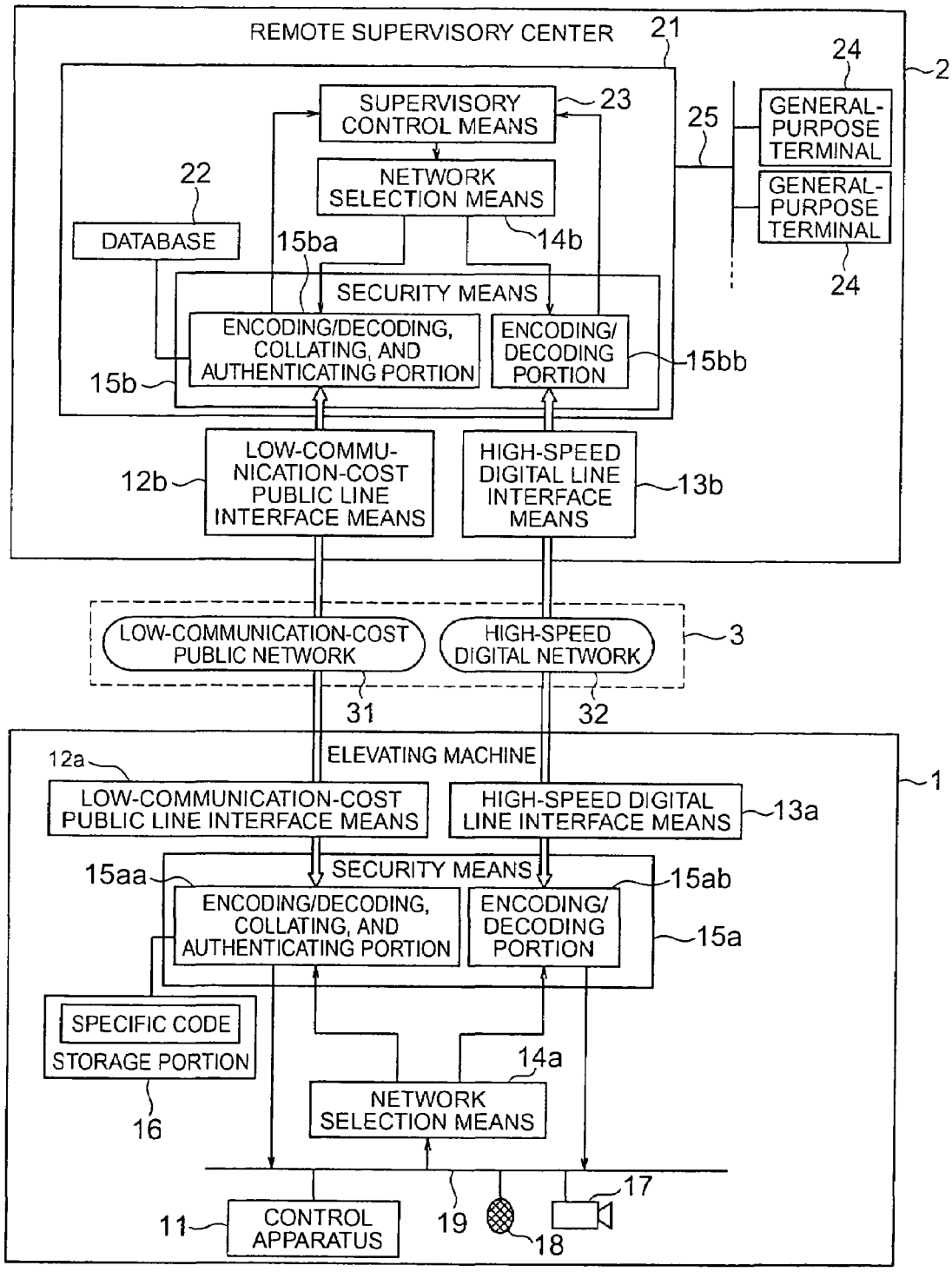
FIG. 1 is a block diagram showing a configuration of a remote supervisory control system for an elevating machine according to an embodiment of the present invention.

FIG. 1 is a block diagram showing a configuration of a remote supervisory control system for an elevating machine according to an embodiment of the present invention. An elevating machine 1 constructed as an elevator, an escalator, or the like is connected to a remote supervisory center 2 via a general public line 3. The remote supervisory center 2 performs centralized supervision of one or a plurality of elevating machines 1 installed in a specific area as a whole. The general public line 3 is composed of a plurality of networks including a low-communication-cost public network 31, a high-speed digital network 32, and the like. The low-communication-cost public network 31 is composed of conventional analog lines, integrated services digital networks (ISDN), and the like. The high-speed digital network 32 is based on virtual private networks (VPN), which are endowed with enhanced security functions and have been frequently used on the Internet among companies these days, and asymmetric digital subscriber lines (ADSL) for general households.

The elevating machine 1 is provided with a control apparatus 11, low-communication-cost public line interface means 12*a*, high-speed digital line interface means 13*a*, network selection means 14*a*, security means 15*a*, a storage portion (storage means) 16, a camera 17, an interphone 18, and a network 19. The control apparatus 11 controls the elevating machine. The low-communication-cost public line interface means 12*a* connects the elevating machine to the low-communication-cost public network 31 of the general public line 3. The high-speed digital line interface means 13*a* connects the elevating machine to the high-speed digital network 32 of the general public line 3. The network selection means 14*a* selects the most appropriate one from the aforementioned plurality of networks (including 31 and 32) and allows transmission of information between the selected network and the remote supervisory center 2. The security means 15*a* provides a security function during transmission of information by encoding/decoding information individually for each of the networks in exchanging the information with the remote supervisory center 2 (by means of an encoding/decoding portion 15*ab*), and performing collation and authentication of, especially, pieces of information regarding control commands for the elevating machine through addition of specific codes to those pieces of information (by means of an encoding/decoding, collating, and authenticating portion 15*aa*). The storage portion 16 stores specific and unique codes allocated to respective elevating machines. The camera 17 is installed within a car, a machine room, or a hoistway to obtain image information. The interphone 18 is installed within the car to obtain audio information. The network 19 connects all these components together.

Further, the remote supervisory center 2 is provided with a database 22, supervisory control means 23, network selection means 14*b*, a server 21, low-communication-cost public line interface means 12*b*, high-speed digital line interface means 13*b*, a general-purpose terminal 24, and a dedicated network 25. Stored in the database 22 are preset specific codes for the respective elevating machines 1. The supervisory control means 23 performs remote supervisory control of the respective elevating machines. The network selection means 14*b* selects the most appropriate one from the aforementioned plurality of networks (including 31 and 32) and allows transmission of information between the selected network and the elevating machines. The server 21 is constructed as security means 15*b* for providing a security function during transmission of information by encoding/decoding information for each of the networks in exchanging the information with the elevating machines (by means of an encoding/decoding portion 15*bb*), and performing collation and authentication of, especially, pieces of information regarding control commands for the elevating machines through addition of specific codes to those pieces of information (by means of an encoding/decoding, collating, and authenticating portion 15*ba*). The low-communication-cost public line interface means 12*b* connects the remote supervisory center 2 to the low-communication-cost public network 31 of the general public line 3. The high-speed digital line interface means 13*b* connects the remote supervisory center 2 to the high-speed digital network 32 of the general public line 3. The general-purpose terminal 24 is constructed as a general-purpose personal computer. The dedicated network 25 connects the server 21 and the general-purpose terminal 24 to each other.

FIG. 2 shows kinds of information to be transmitted through the respective networks. As described above, although the general public line 3 is a single electric wire in a physical sense, there are plural kinds of communication networks conducting communication by means of that electric wire. Therefore, the most appropriate one of the plural kinds of networks is allocated according to the degree of security of information to be transmitted. For example, although malfunction information, image information, and audio information from the elevating machines are large in data transmission volume, no great importance is attached to the security function. Accordingly, it is preferable to transmit those pieces of information through the high-speed digital network 32 that ensures a high speed and a large capacity using VPN, ADSL, and the like. On the other hand, although a control command from the remote supervisory center is small in data transmission volume, a serious problem crops up in the event of an access from a stranger, and therefore, great importance is attached to the security function. Accordingly, it is appropriate to use the low-communication-cost public network 31 such as analog lines and ISDN with low communication costs, after the security function obtained from encoding means and authentication means has been added thereto. The network selection means 14*a* and 14*b* select the most appropriate network according to those pieces of information to be transmitted.

Figure 3:
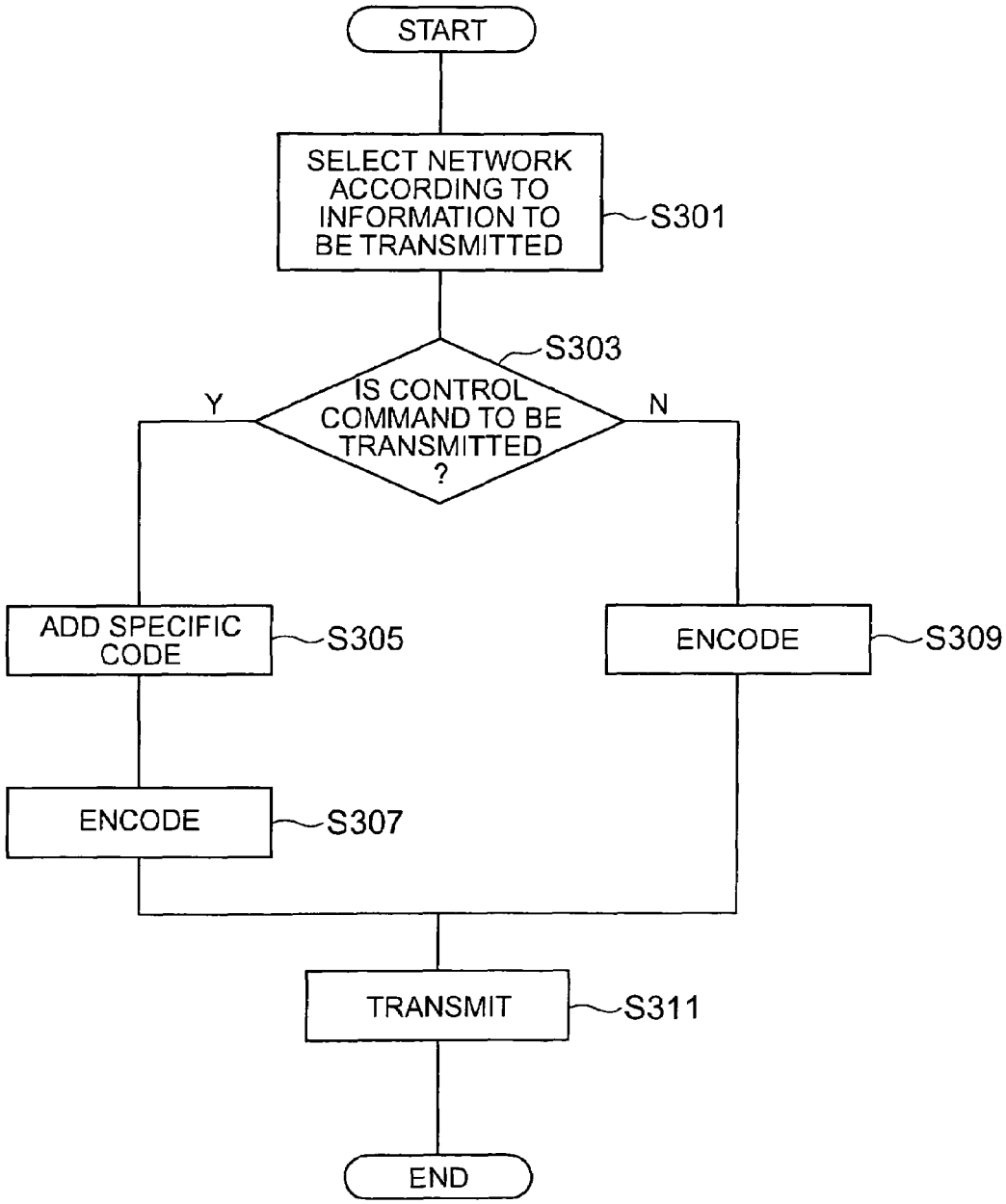
FIG. 3 is a schematic flowchart for explaining an operation performed in a remote supervisory center of the remote supervisory control system shown in FIG. 1.

Next, operation is described. Illustrated in FIG. 3 is a schematic flowchart showing the operation in transmitting information in the remote supervisory center 2. In transmitting information from the supervisory control means 23 of the remote supervisory center 2 to the elevating machine 1, the network selection means 14*b* selects a network in the general public line 3 according to the kind of information to be transmitted (step S301). Especially when the information to be transmitted is a control command to the elevating machine 1 (step S303), the network selection means 14*b* selects the low-communication-cost public network 31 to which an encoding function and a collating and authenticating function are added. When the information to be transmitted is of any other kind, the network selection means 14*b* selects a predetermined network. Especially in the case of large-capacity information such as images, sounds, and the like, the network selection means 14*b* selects the high-speed digital network 32. When the control command is transmitted, a specific code, which is stored in the database 22 and assigned to a destination elevating machine, is added to the control command (step S305) and then encoding for the selected network is carried out (step S307) in the encoding/decoding, collating, and authenticating portion 15*ba* of the security means 15*b*. When information of any other kind is transmitted, only encoding for the selected network is carried out (step S309) in the encoding/decoding, collating, and authenticating portion 15*ba* or in the encoding/decoding portion 15*bb*. It is not determined in the encoding/decoding portion 15*bb* whether or not the information to be transmitted is a control command. The information is then transmitted to the elevating machine 1 side by the low-communication-cost public network 31 or the high-speed digital network 32 via the low-communication-cost public line interface means 12*b* or the high-speed digital line interface means 13*b*, respectively (step S311).

Figure 4:
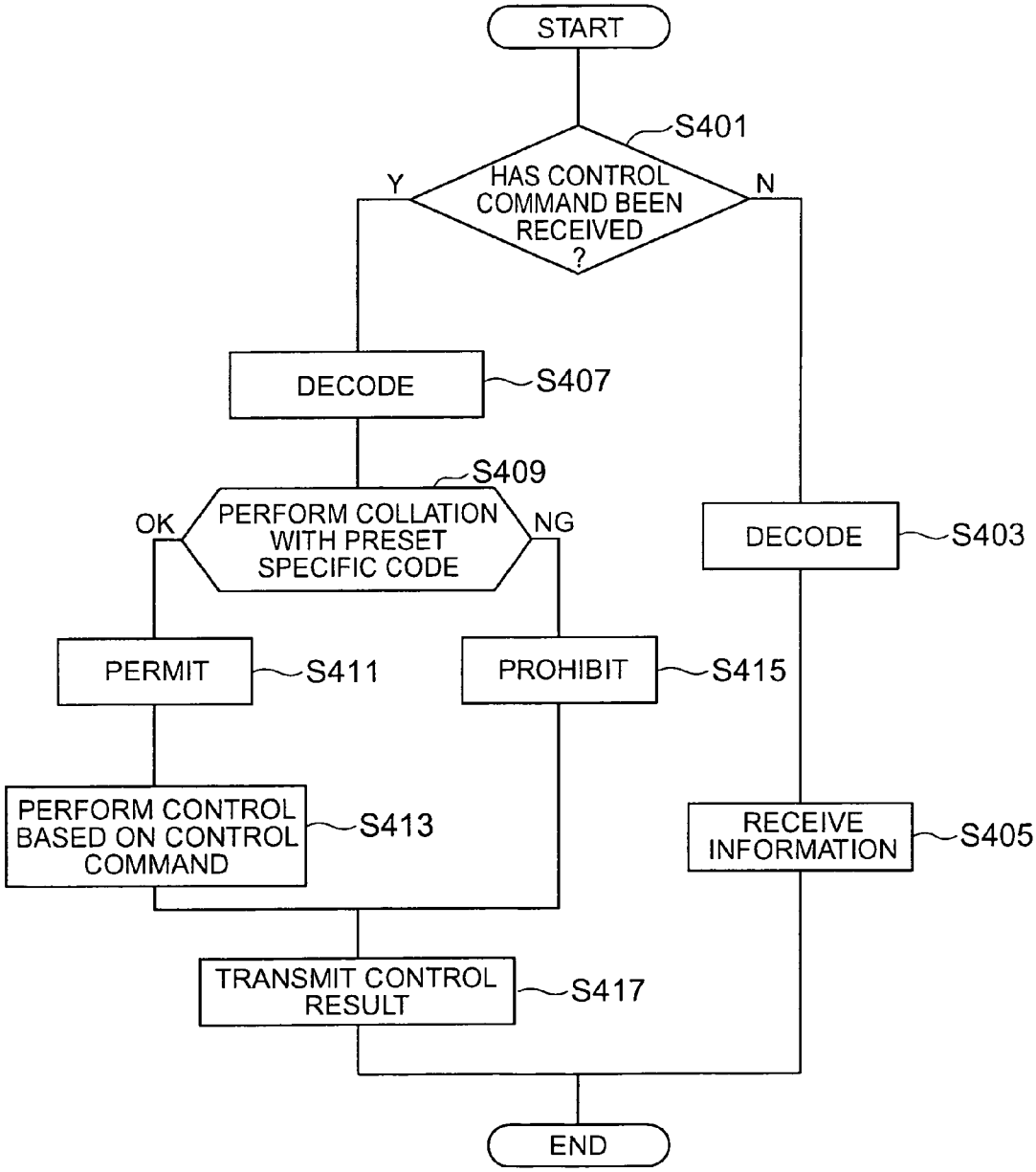
FIG. 4 is a schematic flowchart for explaining an operation performed in an elevating machine of the remote supervisory control system shown in FIG. 1.

Illustrated in FIG. 4 is a schematic flowchart showing the operation in transmitting information in the elevating machine 1. The elevating machine 1 receives information from the supervisory control means 23 of the information remote supervisory center 2, which is transmitted through the low-communication-cost public network 31 and the high-speed digital network 32, via the low-communication-cost public line interface means 12*a* and the high-speed digital line interface means 13*a*, respectively. It is determined in the encoding/decoding, collating, and authenticating portion 15*aa* of the security means 15*a* whether or not the received information is a control command to the elevating machine 1 (step S401). When the received information is not a control command, only decoding for the respective networks is carried out (step S403), and the information is transmitted to the control apparatus 11 and received (step S405). In the encoding/decoding portion 15*ab*, only that decoding is carried out and it is not determined whether or not the information is a control command. On the other hand, when the received information is a control command in step S401, the control command is subjected to decoding (step S407) for the low-communication-cost public network 31. After that, a specific code added to the control command is collated for authentication with a specific code stored in the storage portion 16 (step S409). When both the specific codes coincide with each other and thus fulfill collation and authentication (OK), the control command is permitted as a due command (step S411), and the control apparatus 11 controls the elevating machine on the basis of the control command (step S413). On the other hand, when both the specific codes do not coincide with each other and thus do not fulfill collation and authentication (NG) in step S409, the performance of control based on the control command is prohibited (step S415).

Further, a control result in each of the elevating machines 1 is transmitted to the remote supervisory center 2 via the general public line 3 (step S417). At this moment, when the control result is large-capacity information such as malfunction information, image information, or audio information on the elevating machine, the network selection means 14*a* of the elevating machine 1 selects the high-speed digital network 32 to transmit the information. Further, when large-capacity information such as image information, or audio information is transmitted, the network selection means 14*b* of the remote supervisory center 2 also selects the high-speed digital network 32.

In transmitting important information from each of the elevating machines 1 to the remote supervisory center 2, it may be transmitted in the same manner as the aforementioned control command via the low-communication-cost public network 31 to which the encoding function and the collating and authenticating function are added. In this case, it is appropriate to transmit the information such that the procedures of transmission and receipt are interchanged between the remote supervisory center 2 and the elevating machine 1.

Further, the specific code may be set either when the elevating machine 1 is shipped or after a contract for maintenance has been concluded. The specific code may have a content that is leakproof against strangers, such as an media access control (MAC) address, an internet protocol (IP) address, or a specific access number for each of the elevating machines 1.

INDUSTRIAL APPLICABILITY

According to the present invention, the most appropriate one of communication networks is selected according to the degree of security of information to be transmitted and then communication is established. Thus, the present invention makes it possible to construct a system with an enhanced security function while achieving a reduction in communication cost. Application of the present invention to fields other than the remote supervisory control system for elevating machines is also expected.

The invention claimed is:

1. A remote supervisory control system for an elevating machine, which performs supervisory control of at least one elevating machine in a remote supervisory center via a general public line, the general public line having plural kinds of networks, including a high-speed digital network, for transmitting with large-capacity, information from each of the elevating machines to the remote supervisory center and a low-communication-cost public network for transmitting a control command for perform controlling each of the elevating machines from the remote supervisory center, the remote supervisory control system comprising:

network selection means for, in each of the elevating machines and the remote supervisory center, selecting one network from a plurality of networks, according to information to be transmitted, and causing the network selected to transmit the information, and for selecting the high-speed digital network when the information to be transmitted is large in quantity and the low-communication-cost public network when the information to be transmitted is a control command and causing the network selected to transmit the information;

storage means for storing a specific code that is preset and is specific to one of the elevating machines in each of the elevating machines;

database means for storing the specific code of each of the elevating machines in the remote supervisory center; and security means for, in each of the elevating machines and the remote supervisory center, encoding and decoding transmitted information for each of the plurality of networks, adding the respective specific code to the control command to each of the elevating machines in the remote supervisory center, and collating for authentication the specific code added to the control command from the remote supervisory center with the specific code stored at the elevating machine, in each of the elevating machines.

2. The remote supervisory control system for an elevating machine according to claim 1, wherein the information large in quantity transmitted from each of the elevating machines to the remote supervisory center includes at least one of state information, image information, and audio information.

3. The remote supervisory control system for an elevating machine according to claim 1, wherein the high-speed digital network is a VPN or ADSL network, and that the low-communication-cost public network is an ISDN network or analog lines.

4. The remote supervisory control system for an elevating machine according to claim 2, wherein the high-speed digital network is a VPN or ADSL network, and that the low-communication-cost public network is an ISDN network or analog lines.

* * * * *